US005757606A

United States Patent [19]

Westerberg

[11] Patent Number: 5,757,606

[45] Date of Patent: May 26, 1998

[54] ELECTRICAL GROUND CONNECTION FOR POWDER PAINTING APPARATUS

[76] Inventor: Arlyn R. Westerberg, 1041 35th Ave., Amery, Wis. 54001

[21] Appl. No.: 730,466

[22] Filed: Oct. 11, 1996

[51] Int. Cl.[6] ..... H01H 3/00

[52] U.S. Cl. ..... 361/227; 118/630; 427/477

[58] Field of Search ..... 361/225–228; 211/113; 118/500, 621, 630; 427/477, 483; 204/623, 198

[56] References Cited

U.S. PATENT DOCUMENTS 4,263,122 4/1981 Urguhart ..... 204/623

*Primary Examiner*—Jeffrey A. Gaffin
*Assistant Examiner*—Sally C. Medley
*Attorney, Agent, or Firm*—Ryan, Maki, Mann & Hohenfeldt

[57] ABSTRACT

Apparatus for electrostatically applying a coating to articles in a chamber includes nozzles for discharging a fluid stream of coating composition, usually a dry powder, into the chamber. An electrical charge is applied to the individual particles of the coating composition. An endless conveyor supports suspended racks on which the articles to be coated are supported. Electrically grounded conductive strips having a projecting edges electrically ground each of the racks they move through the chamber. The strips have a thin flat profile with a laterally projecting edge to frictionally engage the racks moving through the chamber. Preferably the edge is vertically inclined so that the point on the racks contacted by the edge continually varies as the racks are conveyed, thus insuring a scraping action and good electrical contact between the grounding strip and the rack.

8 Claims, 3 Drawing Sheets

ELECTRICAL GROUND CONNECTION FOR POWDER PAINTING APPARATUS

FIELD OF THE INVENTION

This invention relates to equipment for solventless painting. More specifically, the invention relates to equipment for painting using electrically charged powders deposited onto electrically charged grounded surfaces which are provided with a system for improved electrical grounding of the same.

BACKGROUND OF THE INVENTION

Environmental concerns regarding evaporation into the atmosphere of various solvents during conventional painting procedures have given rise to development of electrostatic painting procedures which entirely eliminate the use of solvents. Such painting is typically conducted in a chamber which is provided with numerous nozzles for discharging a powder spray against the electrically-grounded articles being coated. The nozzles are provided with means to apply an electrical charge to the individual pigmented particles which then are electrostatically attracted to the grounded articles. Also provided in the chamber is a track, usually along the ceiling of the chamber, through which a conveyor system is mounted. Individual racks are suspended from the conveyor to, in turn, support the articles which are to be coated. Additionally, flexibility may be added to the supporting racks by using upper and lower portions of more than one part, which may flex relative to each other. All of the resultant joints formed between connecting parts form regions through which electrical conductivity is reduced. Thus, the parts being coated are often not adequately grounded with the result that the coating of powdered paint material is not uniform.

SUMMARY OF THE INVENTION

It is a principal object of the invention to provide an improved grounding system for solventless electrostatic powder painting systems. In accordance with one aspect of the invention, a grounding device is formed by a series of contact strips which successively are engaged by a rack for objects being electrostatically painted as they are conveyed through a painting booth.

In accordance with a further aspect of the invention, each of the rack-contacting strips is provided with thin, sharp laterally projecting edges for making positive electrical contact with article-supporting racks. In accordance with a further aspect of the invention, it is preferred that the rack-engaging strips have contact edges which are inclined so that the surface of the rack engaging the strip is continuously subjected to a scraping motion, thereby optimizing contact between the racks and the ground strips.

Another advantage of the present invention relates to the fact that each product-containing rack is grounded directly to the grounding strip thus bypassing the need for any electrical circuit to pass through a series of electrical contacts through the rack supports.

Briefly, the invention provides apparatus for electrostatically applying a coating to articles in a chamber which includes nozzles for discharging a fluid stream of coating composition, usually a dry powder, into the chamber. An electrical charge is applied to the individual particles of the coating composition. An endless conveyor supports suspended racks on which the articles to be coated, in turn, are supported. Electrically grounded conductive strips having a projecting edges electrically ground each of the racks they move through the chamber. The strips have a thin flat profile with a laterally projecting edge to frictionally engage the racks moving through the chamber. Preferably the edge is vertically inclined so that the point on the racks contacted by the edge continually varies as the racks are conveyed, thus insuring a scraping action and good electrical contact between the grounding strip and the rack.

Further objects and advantages of the invention will be apparent from the following detailed description, the claims and the accompanying drawings.

DETAILED DESCRIPTION OF A PREFERRED EMBODIMENT

Figure 1:
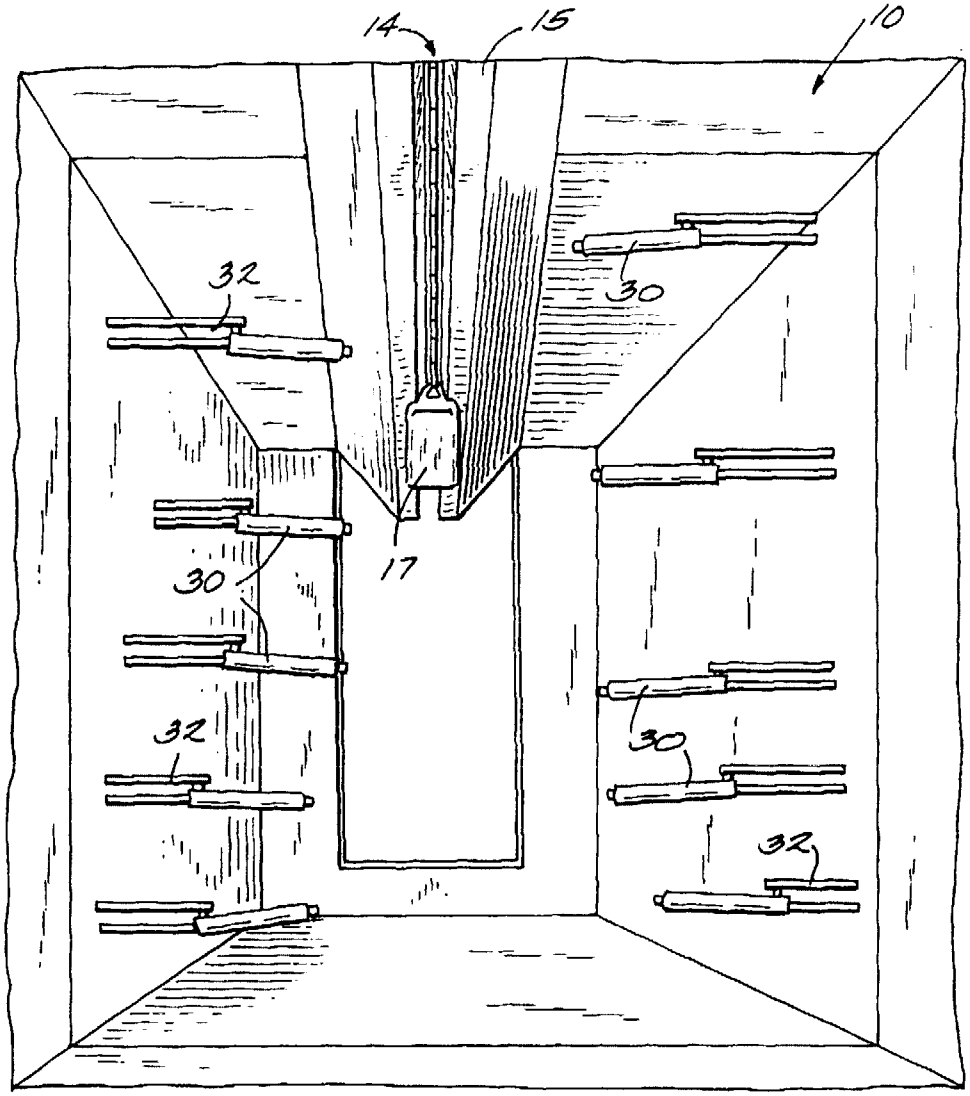
FIG. 1 is a view of the interior of a painting enclosure of the present invention viewed from one end.

Referring more particularly to the drawings, there is seen in FIG. 1 the overall apparatus 10 of this invention. Apparatus 10 includes an enclosed chamber 12 wherein electrostatic painting is carried out. Apparatus 10 also includes a rack system 14 which is suspended through an opening 15 in the ceiling of chamber 12.

For access and 14 includes a number of individual racks 16 which are adapted to support and convey individual articles 17 which are being painted. Attachment means such as eyelets or hooks 18 are provided for the purpose of supporting a variety of shapes of articles 17. In some cases, racks 16 may be configured to conveniently support an article to be painted of a given shape or configuration.

Figure 2:
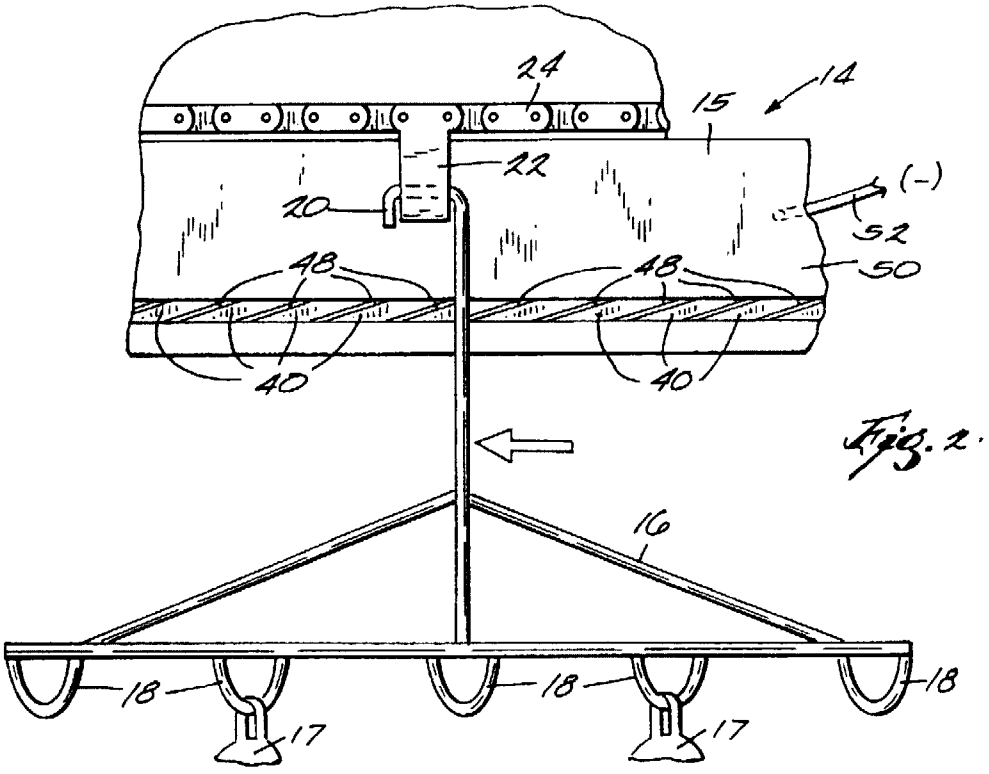
FIG. 2 is a fragmentary side elevational view showing the conveying and selectrically grounding systems used in connection with the invention.
Figure 3:
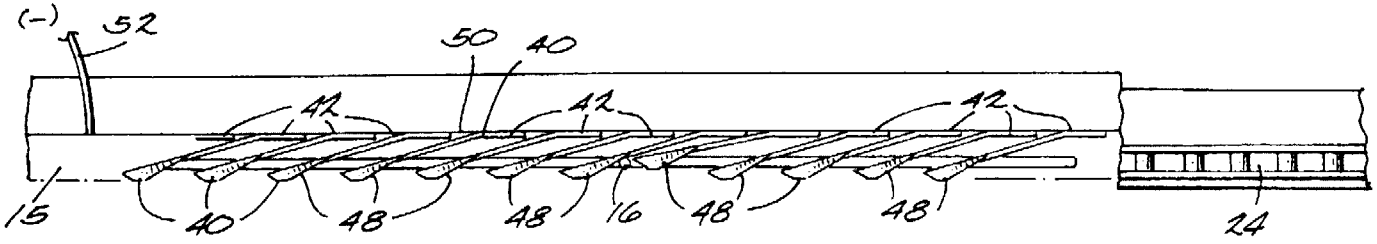
FIG. 3 is a fragmentary top view illustrating the conveying and grounding systems of the equipment.

As best seen in FIG. 2, the upper end of rack 16 is provided by a hook 20 adapted to be supported by a bracket 22 which is in turn integral with a conveyor chain 24. Conveyor chain 24 is preferably of an endless type driven by conventional conveying means such as an electric motor (not shown).

Also provided within chamber 12 are a plurality on each side of the chamber of discharge nozzles 30 of conventional construction and configuration. It will be noted that the nozzles 30 are provided at different elevations and angular disposition relative to the racks 16 so that all surfaces of articles 17 will be uniformly coated. Nozzles 30 are provided with conventional electrical supply including switches 32. Thus, the dry paint particles expelled by nozzles 30 are provided with a positive electrical charge whereas the rack 16 and thus the articles 17 being coated are being electrically grounded.

Figure 7:
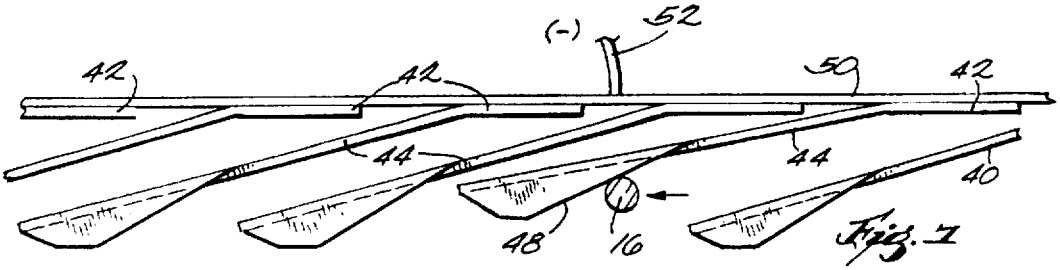
FIG. 7 is an enlarged top view of a fragmentary portion of the grounding system of this invention with an article-conveying rack shown on cross-section.
Figure 8:
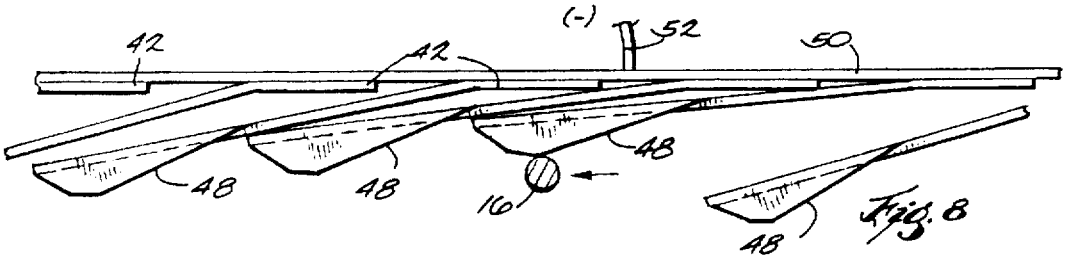
FIGS. 8 and 9 are further views of the grounding system illustrated in FIG. 7 showing further movement there along by the conveying rack.
Figure 9:
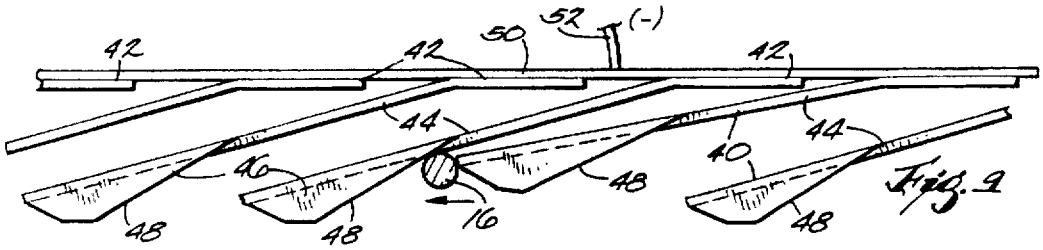
Figure 4:
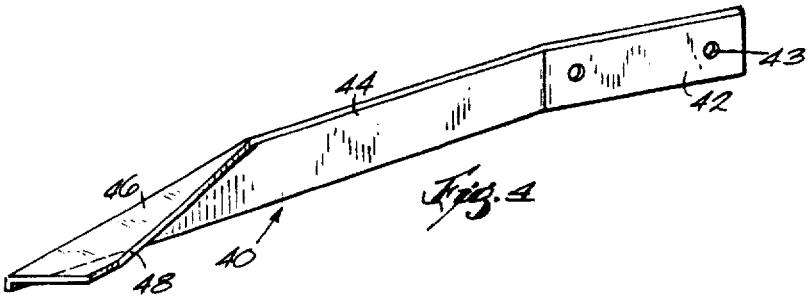
FIG. 4 is a perspective view of an individual grounding strip used in connection with the invention.
Figure 5:
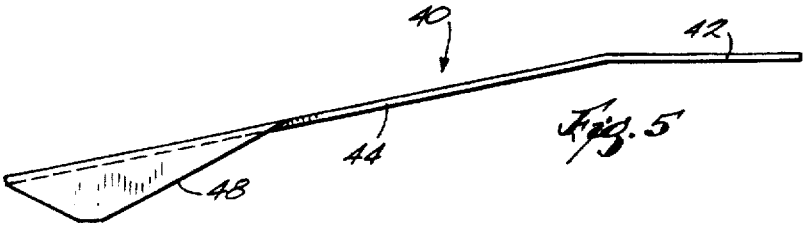
FIG. 5 is a top view of the grounding strip of FIG. 4.
Figure 6:
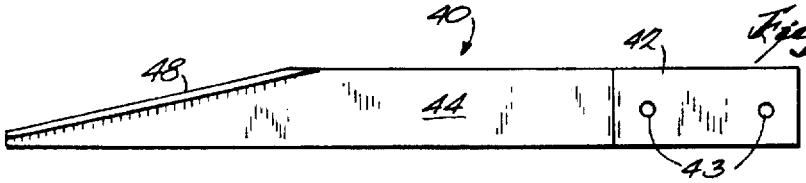
FIG. 6 is a side elevational view of the grounding strip of FIG. 4.

Referring again to FIG. 2, it will be appreciated that if electrical grounding of articles 17 is provided as in conventional manner through the conveying chain 24, bracket 22, hook 20 and loops 18, that a great number of electrical connections are involved. If any of these electrical connections do not provide an adequate flow of electrons, the articles 17 will not be appropriately grounded or negatively charged. Thus, the electrostatically-charged paint particles discharged through nozzles 30 will not adequately cling to the articles 17 in the prior art. Referring to FIGS. 2–9, or, the improved grounding system of this invention is shown in detail. It will be noted that the grounding system of this invention includes a number of grounding strips 40 which may be formed of an appropriate conductive material such as copper or brass. Each strip 40 has a base or attachment portion 42 at one end which is provided with holes 43 to facilitate attachment of strips 40 to an electrically grounded surface by means of rivets or screws. Integral with and attachment sections 42 are a main body portion 44. Body portion 44 is somewhat flexible so that the grounding strips 40 can pivot as contacted by racks 16. The strips 40 will also exert some spring force against the racks 16. Each strip 40 has a distal end section 46 opposite from attachment and 42 which is folded over preferably at 90 degrees relative to body portion 44. End portion 46 thus presents a sharp edge 48 against which a vertical portion of racks 16 slides as it moves through the chamber 12. As seen in FIG. 7–9, each strip 40 is attached to a grounded supporting surface 50. Supporting surface 50 is attached to an electrical ground by means of an appropriate ground wire 52. Also as seen in FIG. 7–9, as rack 16 travels generally in the direction of the arrows shown in the figures, strips 40 are free to flex slightly toward ground surface 50, thus assuring good pressure against the contact surface of rack 16. Also note that due to the inclined, angular surface presented by edge 48 there will be continual scraping action against the vertical shaft of rack 16 as it advances through chamber 12. As seen in FIG. 9, vertical shaft portion of the rack 16 engages another of the strips 40 just as soon as it leaves, contact with the preceding strip. The continuous grounding of the strips is thus assured.

Supporting surface 50 should also be formed of a highly electrically-conductive material. It may be formed, for example, from an aluminum beam. It will thus be apparent, referring again to FIG. 2, that the grounding strips effectively electrically ground each of the racks 16. Thus, the connections presenting potential problems are limited to the electrical path between supporting loops 18 and article 17.

While certain preferred embodiments of the invention have been shown for purposes of illustration it will be understood that the true scope of the invention is determined by the appended claims including structures equivalent thereto.

What is claimed is:

1. Apparatus for electrostatically applying a coating to articles comprising a chamber, means for discharging into said chamber a fluid stream of coating composition, said means including means for applying an electrical charge to individual particles of said composition, an endless conveyor for conveying articles through said chamber including, said conveyor supporting a plurality of suspended racks for supporting and conveying said articles, and, means for electrically grounding said racks as they are conveyed through said chamber including at least one electrically grounded electrically conductive strip having a flattened laterally projecting edge adapted to scrapingly contact and electrically ground each of said racks as said racks move through said chamber.

2. Apparatus according to claim 1 wherein said strip is attached to an electrically grounded surface at a first end and has a thin flat profile at a second end opposite said first end, which second end is provided with a laterally projecting edge of a progressively increasing width toward said second end, said racks each having a surface frictionally and scrapingly engaging said edge as said racks move through said chamber.

3. Apparatus according to claim 2 wherein said edge is inclined from the horizontal whereby the point on said racks contacted by said edge continually changes as said racks are conveyed through said chamber.

4. Apparatus according to claim 2 comprising a plurality of said electrically conductive strips.

5. Apparatus according to claim 4 wherein each of said strips comprises copper.

6. Apparatus according to claim 4 wherein said electrically conductive strips are sequentially arranged whereby each of said racks sequentially engages said strips as it travels through said chamber.

7. Apparatus according to claim 1 wherein said projecting edge is inclined from the horizontal and is of a generally triangular shape formed by folding a second end relative to the body of said strip.

8. Apparatus according to claim 1 wherein said conductive strip is formed of a flexible metal which is capable of yielding when contacted by one of said suspended racks and exerting a biasing force toward said rack.

* * * * *